United States Patent [19]

Moen

[11] 4,282,999

[45] Aug. 11, 1981

[54] H-DIVIDER CONTAINERS

[76] Inventor: Lenard E. Moen, 7914 Michigan Ave., Whittier, Calif. 90602

[21] Appl. No.: 153,276

[22] Filed: May 27, 1980

Related U.S. Application Data

[62] Division of Ser. No. 910,198, May 30, 1978, Pat. No. 4,220,076.

[51] Int. Cl.[3] ..... B65D 5/32; B65D 5/48

[52] U.S. Cl. ..... 229/15; 229/23 R; 206/427; 206/564

[58] Field of Search ..... 229/15, 23 R, DIG. 4

[56] References Cited

U.S. PATENT DOCUMENTS

| | | | |
|---|---|---|---|
| 2,139,845 | 12/1938 | Neely | 229/DIG. 4 |
| 2,593,092 | 4/1952 | Bergstein | 229/15 X |
| 3,050,228 | 8/1962 | Lane | 229/15 |
| 3,756,496 | 9/1973 | Oostdik | 229/15 |
| 3,758,018 | 9/1973 | Black | 229/15 |
| 3,982,684 | 9/1976 | David | 229/15 X |
| 3,985,286 | 10/1976 | Hicks | 229/15 |
| 4,124,158 | 11/1978 | Beck | 229/15 |
| 4,164,312 | 8/1979 | Harned | 229/15 |
| 4,194,678 | 3/1980 | Jasper | 229/23 R |

*Primary Examiner*—Davis T. Moorhead

*Attorney, Agent, or Firm*—Frederick E. Mueller

[57] ABSTRACT

A corrugated or fiber board two-piece H-divider container comprising an H blank that has been erected and glued upon itself and body blank that has been erected and glued around the H-divider. The vertical divider panels of the H-piece are folded at the bottom along a hinge line that includes two spaced crush score line areas interrupting a slit score line. The divider panels each have a pair of integral end wall panels to which marginal flaps of the body blank are secured.

15 Claims, 7 Drawing Figures

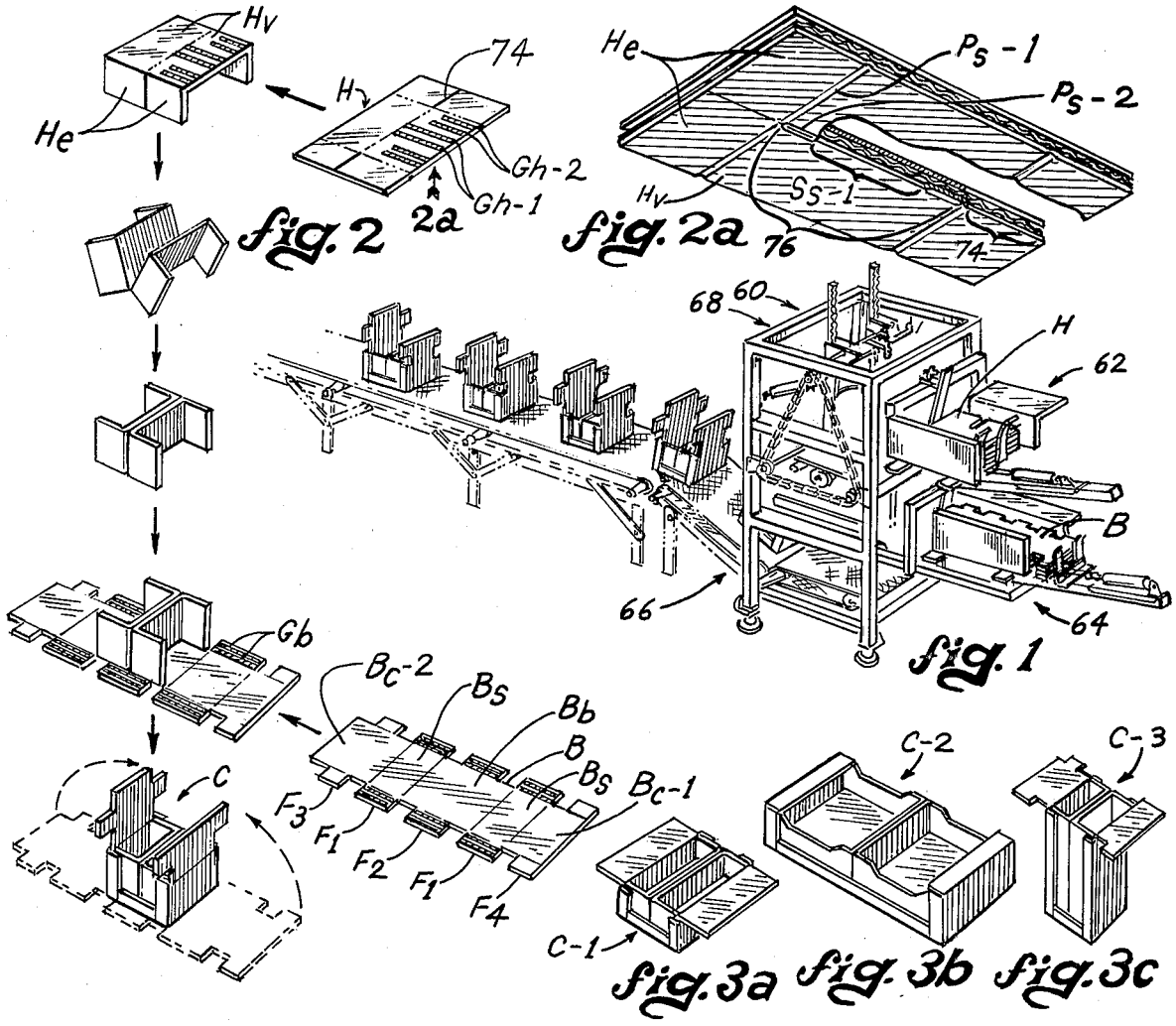
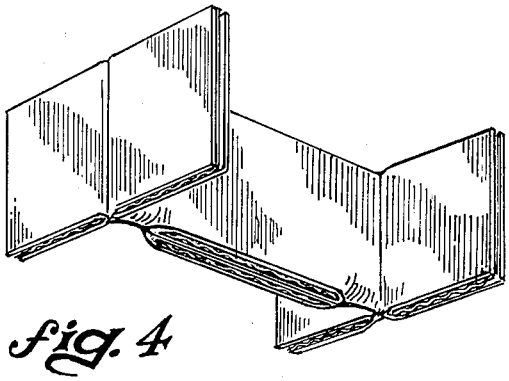
fig. 4

H-DIVIDER CONTAINERS

REFERENCE TO RELATED APPLICATION

This a divisional application of pending prior application Ser. No. 910,198, filed on May 30, 1978, now U.S. Pat. No. 4,220,076, issued Sept. 3, 1980.

BACKGROUND OF THE INVENTION

This invention relates to H-divider containers and, more particularly, to an improved container geometry. A number of methods and machines are known in the prior art for manufacturing a variety of containers of the type which are divided into cellular spaces. These include, for example, the following U.S. patents: Derderian U.S. Pat. No. 3,605,572, Richardson et al. U.S. Pat. No. 2,879,700, Roda U.S. Pat. No. 3,780,627, Russell U.S. Pat. No. 3,396,896, Frankenstein U.S. Pat. No. 2,837,982, Forrer U.S. Pat. No. 3,397,623, Randle U.S. Pat. No. 3,921,893 and Lovett et al. U.S. Pat. No. 3,225,665.

SUMMARY OF THE INVENTION

The H-divider container is made of two flat pieces, namely, a body blank and an H-divider blank. The latter is slit and scored to define two divider panel areas, each of which is flanked by integral end wall panel areas. A transverse fold or hinge line joining the divider panel areas at the bottom is defined in part by a slit score line leaving the top liner intact, the hinge at opposite ends spaced inwardly also including a pair of crush score line areas interrupting the slit score.

BRIEF DESCRIPTION OF THE DRAWINGS

FIG. 1 is a perspective view of a box making machine employed in manufacture of H-divider containers of the invention.

FIG. 2 is a schematic flow diagram of steps in the process of making an H-divider container from an H-blank and a body blank.

FIG. *2a* is a bottom view of an H-blank with a portion cut away to show its cut, slit and press type scores.

FIGS. *3a, 3b,* and *3c* are perspective views of different sizes and styles of H-containers.

FIG. 4 is a perspective view of a completely formed and glued H-divider of the invention.

DESCRIPTION OF THE PREFERRED EMBODIMENT

The presently preferred embodiment of machine for making the H-divider inserts or containers of this invention is full disclosed in my pending application Ser. No. 910,198 and has the general arrangement shown in FIG. 1. A vertically elongate rigid framework 60 on one side mounts both a high hopper and feed assembly 62 and a low hopper and feed assembly 64. The upper assembly 62 holds and individually feeds a supply of horizontally disposed vertically stacked flat preformed H-divider blanks H while the lower assembly 64 holds and feeds, one at a time, a supply of horizontally disposed vertically stacked flat preformed body blanks B. A discharge conveyor assembly 66 is incorporated into the lower end of the machine framework 60.

The machine automatically performs the forming operations illustrated in FIG. 2. To this end, the machine at its upper end, at the level of the upper hopper assembly 62, incorporates an H-fold mechanism 68 in vertical alignment above a split mandrel means 70. The split mandrel 70, in turn, is flanked by opposite sides of a means 72 for folding and forming the body blank B about the mandrel means 70. A completed H-divider container C is formed in a single cycle of operation of the machine.

More particularly, the H-divider blank H and body blank B, which are typically of corrugated cardboard or fiberboard, may have the plan configurations shown in FIG. 2. The completed container C consists of a pair of these two blanks.

The preformed flat panel H is scored and cut to define relatively foldable areas including a pair of panel areas $H_v$ each of which, in turn, is transversely flanked by a pair of end wall panel areas $H_e$. Adjacent edges of each pair of panels $H_e$ are severed from one another by a cut score 74 at opposite ends of a central transverse hinge line 76 having a predetermined score arrangement whose function and geometry will be explained presently. As will become apparent from an examination of FIG. 2, the panels $H_v$ of the flat blank H subsequently become the central vertical laminated divider panel of the completed container C while the areas $H_e$, when erected, define a pair of opposite walls of the completed container. During initial infeed travel of the blank H, a predetermined pattern of glue stripes $G_h$-1 and $G_h$-2 is deposited on one of the panel areas $H_v$.

Preferably, as in FIG. *2a,* the junction of the panel areas $H_e$ and $H_v$ takes the form of a press score $P_s$-1 on the bottom surface of the H-divider blank which will leave both skins intact. The separation 74 of an adjacent pair of panels $H_e$ may take the form of a gap or notch but preferably comprises a cut score or slit through both liners and the fluted intermediate layer.

The transverse hinge 76 comprises a slit score $S_s$-1 through the bottom liner and the fluted intermediate layer but not through the top liner. This slit score $S_s$-1 is aligned with cut scores 74. Between the inward ends of the cut scores 74 and the opposite ends of slit score $S_s$-1 there is a press score section $P_s$-2 of 5.4 centimeters (2 $\frac{1}{8}$ in.) length, on each side, where the corrugated material is not slit in order to provide a solid contact area for downfeed fingers of the H-fold mechanism 68 during the folding operations which will be explained presently. The bottom liner only is press scored in sections $P_s$-2 of hinge 76 in order to pre-stretch the material to enable it to accommodate the 90° bend of the material on forming, with less resistance and with less deformation of the material. In some cases the cut scores 74 may be extended inwardly slightly, e.g., 1.6 centimeters ($\frac{5}{8}$ in.) beyond press score $P_s$-1.

In the process illustrated in FIG. 2, the four end panel areas $H_e$ are first rotated downwardly substantially 90° relative to the common plane of the two areas $H_v$. This initial folding occurs as a function of movement of the preformed flat blank H from the supply stack to an indexed position in the H-fold mechanism 68. The H-fold mechanism then engages opposite end press score portions $P_s$-2 of the hinge line 76 to move the blank downwardly, effecting folding of the panel areas $H_v$ against one another and simultaneously effecting rotation of the already folded end panel areas $H_e$. Thereafter, the H-divider areas $H_v$ are subjected to compression within the mandrel means 70, momentarily, preparatory to having a body blank B formed around the H-divider and mandrel.

The blank B is preformed with a pattern of notches and score lines to define a central bottom panel area $B_b$ that is longitudinally flanked by a pair of side wall areas $B_s$. The bottom panel area $B_b$ is transversely flanked at opposite sides by a pair of flaps $F_2$ while each of the areas $B_s$ is transversely flanked along opposite sides with marginal flaps $F_1$. If the completed container is of the type to undergo subsequent top sealing, the blank B may be provided at opposite ends with, e.g., cover flap portions $B_c$-1 and $B_c$-2, the latter having a longer longitudinal dimension than the cover flap $B_c$-1. The area $B_c$-2 is provided with opposite side marginal flaps $F_3$, offset from the extreme end of the area $B_c$-2. The area $B_c$-1 is provided along opposite sides with a pair of marginal flaps $F_4$ having ends coterminus with the adjacent or corresponding extreme edge of the blank B.

In the process illustrated in FIG. 2, the flat body blank B is delivered from the supply thereof into a flat indexed position beneath a fully formed H-divider held within the mandrel means 70 and slightly spaced therebeneath. Thereafter, the body blank fold and die plate mechanism 72 moves the blank B upwardly into contact with the lower edge of the H-divider, effects 90° folding of the areas $B_s$ relative to the bottom panel area $B_b$, and effects partial inward turning of all of the flaps $F_1$, $F_2$. Finally, the body blank fold and die plate mechanism completes inward folding and compression of the flaps $F_1$, $F_2$ to bring the glue stripes $G_b$ into adhering contact with the glue joint areas of the H-divider end wall areas $H_e$. Upon the next fully erected H-divider being introduced into the mandrel means 70, the fully formed container C is ejected from the mandrel means by the incoming H-divider.

In the manufacture of the blank H, it should be understood that all cuts and scores are made on one side only, usually the top side. The slit and scored blank is then inverted to the attitude shown in FIG. 2*a* wherein that liner which has been slit, e.g., at $S_s$-1, faces downwardly when the blank is placed in the high hopper 62. As is shown in FIG. 2, the infeed direction of a blank H is at 90° to the hinge 76.

Similarly, the blank B is formed with the scores on one side only and preferably is placed in the low hopper and feed means 64 with the score side up.

While the invention has been disclosed and described in connection with preferred embodiments of the H-blank insert, H-divider container, process, and machine, it will be appreciated by those skilled in the art that the invention is not limited to the disclosed embodiments but is susceptible of being carried into effect by other embodiments.

I claim:

1. A preformed paperboard blank to be erected into an H-divider configuration, said blank comprising a paperboard sheet consisting of a layer sandwiched between a pair of liners and defining:

a pair of divider panels joined together along a hinge line, a pair of end wall panels at the transversely opposite ends of each of said divider panels and foldably joined to the corresponding one of said divider panels, said hinge line comprising a slit score length in which one liner and the corresponding part of said layer are severed, leaving the other liner intact.

2. A blank as in claim 1 wherein said hinge line comprises a spaced pair of crush score lengths, at opposite ends of said slit score length, in which both liners and said layer are left unsevered.

3. A blank as in claim 2 wherein said pair of crush score lengths constitute the opposite end portions of said hinge line.

4. A blank as in claim 2 in which said hinge line comprises a spaced pair of cut score lengths, constituting the opposite end portions of said hinge line, in which both liners and said layer are severed.

5. A blank as in claim 1 in which said layer of said paperboard sheet is corrugated and said hinge line extends transversely of the flutes of said corrugated layer.

6. An H-divider comprising an integral sheet of paperboard consisting of a layer sandwiched between a pair of liners and erected to define an H shape, in plan, configuration wherein a pair of divider panels have been reversely folded into abutting registration with one another, having one edge only joined along a hinge line, said hinge line comprising a slit score length in which the outside one of said liners and the corresponding part of said layer are severed, leaving the inside liner intact, each of said divider panels at opposite ends having an integral pair of end wall panels folded at 90° to said divider panels.

7. An H-divider as in claim 6 wherein said hinge line comprises a spaced pair of crush score lengths, at opposite ends of said slit score length, in which both liners and said layer are left unsevered.

8. An H-divider as in claim 7 wherein said pair of crush score lengths constitute the opposite end portions of said hinge line.

9. An H-divider as in claim 7 in which said hinge line comprises a spaced pair of cut score lengths, outwardly of said crush score lengths, constituting the opposite end portions of said hinge line, in which both liners and said corrugated layer are severed.

10. An H-divider as in claim 6 in which said layer of said paperboard sheet is corrugated and said hinge line extends transversely of the flutes of said corrugated layer.

11. In an H-divider container comprising an erected H-divider defining a pair of opposite end walls of the container, and an erected body wrap comprising an integral sheet defining a bottom panel and a pair of opposite side walls of the container with each of the side walls having opposite marginal flaps secured to vertical edge portions of the end wall panels of said H-divider, the improvement comprising;

said H-divider comprising an integral sheet consisting of a layer sandwiched between a pair of liners and erected to define an H-shape in plan configuration with a pair of divider panels in abutting reversely folded registration with one another, said divider panels having lower edges only joined along a hinge line;

said hinge line comprising a slit score length in which the outside one of said liners and the corresponding part of said layer are severed leaving the inside liner intact.

12. The improvement of claim 11 wherein said hinge line comprises a spaced pair of crush score lengths, at opposite ends of said slit score length, in which both liners and said layer are left unsevered.

13. The improvement of claim 12 wherein said pair of crush score lengths constitute the extreme opposite end portions of said hinge line.

14. The improvement of claim 12 in which said hinge line comprises a spaced pair of cut score lengths, constituting the opposite end portions of said hinge line, in which both liners and said layer are severed.

15. The improvement of claim 11 in which said H-divider sheet is corrugated paperboard and said hinge line extends transversely of the flutes of the corrugated layer.

* * * * *